United States Patent [19]

York

[11] 4,430,309

[45] Feb. 7, 1984

[54] ACID WASH OF SECOND CYCLE SOLVENT IN THE RECOVERY OF URANIUM FROM PHOSPHATE ROCK

[75] Inventor: William R. York, Bartow, Fla.

[73] Assignee: Wyoming Mineral Corporation, Lakewood, Colo.

[21] Appl. No.: 292,096

[22] Filed: Aug. 12, 1981

[51] Int. Cl.[3] ..... C01G 43/00

[52] U.S. Cl. ..... 423/10; 423/15

[58] Field of Search ..... 423/8–10, 423/15

[56] References Cited

U.S. PATENT DOCUMENTS

| | | | |
|---|---|---|---|
| 3,288,568 | 11/1966 | Tomijima et al. | 423/9 |
| 3,711,591 | 1/1973 | Hurst et al. | 423/10 |
| 3,966,873 | 6/1976 | Elikan et al. | 423/10 |
| 4,002,716 | 1/1977 | Sundar | 423/10 |
| 4,105,741 | 8/1978 | Wiewiorowski et al. | 423/10 |
| 4,207,294 | 6/1980 | Hirono | 423/10 |
| 4,258,013 | 3/1981 | Pyrih et al. | 423/15 |

OTHER PUBLICATIONS

Hurst et al., "Solvent Extraction of Uranium from Wet Process Phosphoric Acid", ORNL-TM-2522, pp. 15–16 (1969).

*Primary Examiner*—Edward A. Miller
*Attorney, Agent, or Firm*—D. P. Cillo

[57] ABSTRACT

Entrainment of contaminated water in the organic phase and poor phase disengagement is prevented in the second cycle scrubber, in a two cycle uranium recovery process, by washing the organic solvent stream containing entrained $H_3PO_4$ from the second cycle extractor, with a dilute aqueous sulfuric or nitric acid solution in an acid scrubber, prior to passing the solvent stream into the second cycle stripper.

6 Claims, 1 Drawing Figure

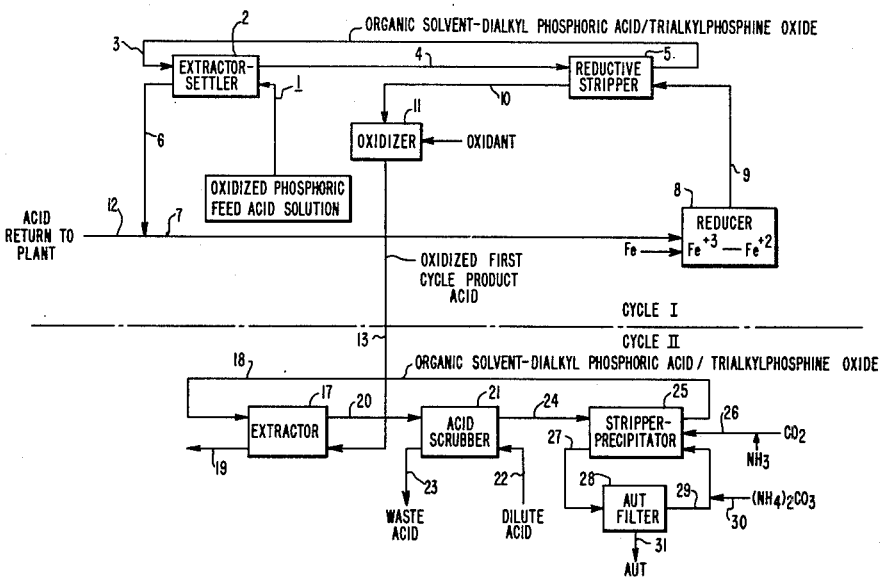

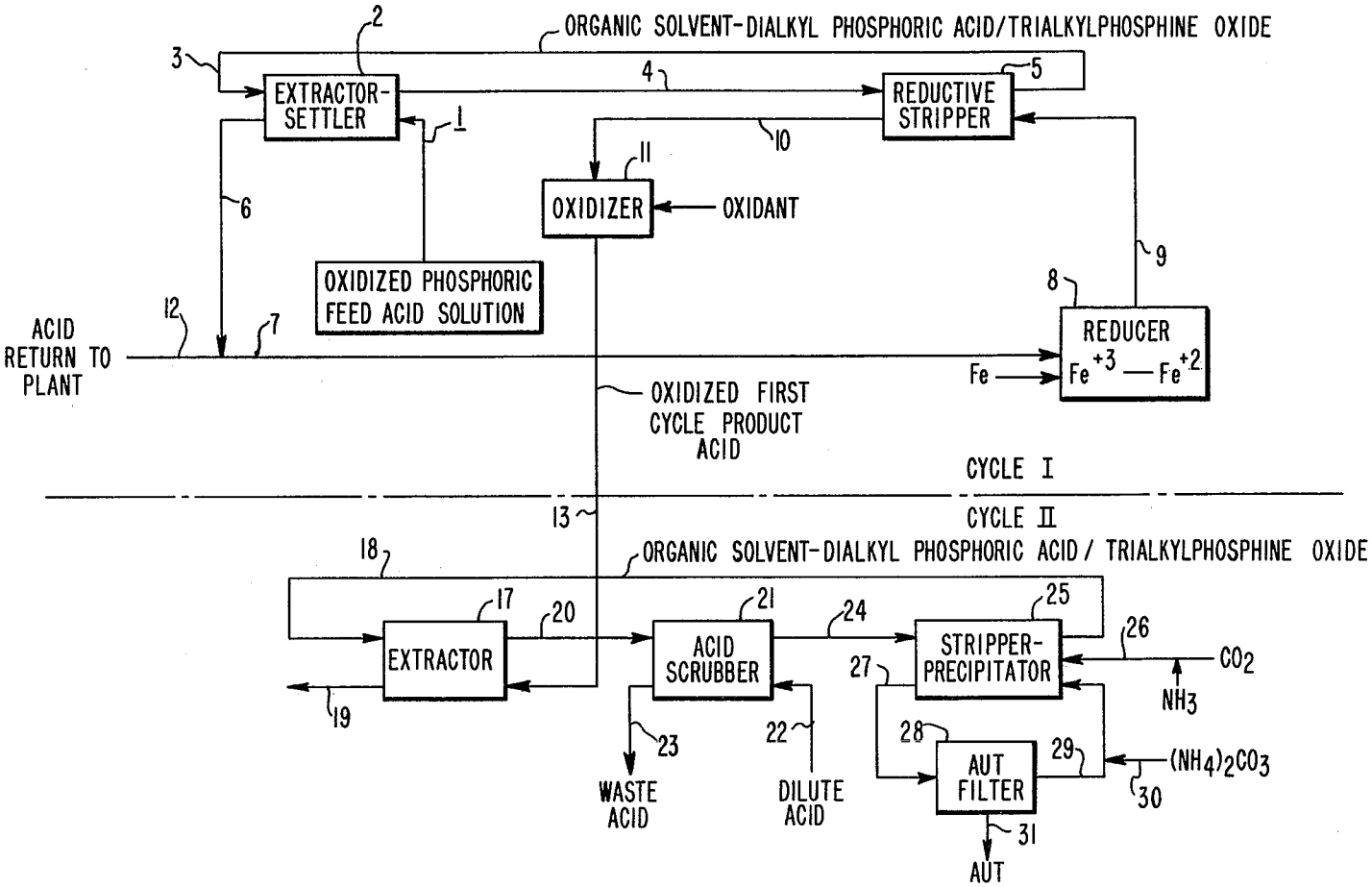
ORGANIC SOLVENT-DIALKYL PHOSPHORIC ACID/TRIALKYLPHOSPHINE OXIDE
EXTRACTOR-SETTLER
REDUCTIVE STRIPPER
OXIDIZER
OXIDANT
REDUCER
$Fe^{+3} \rightarrow Fe^{+2}$
Fe
OXIDIZED PHOSPHORIC FEED ACID SOLUTION
OXIDIZED FIRST CYCLE PRODUCT ACID
ACID RETURN TO PLANT
CYCLE I
CYCLE II
ORGANIC SOLVENT-DIALKYL PHOSPHORIC ACID / TRIALKYLPHOSPHINE OXIDE
EXTRACTOR
ACID SCRUBBER
STRIPPER-PRECIPITATOR
AUT FILTER
$CO_2$
$NH_3$
$(NH_4)_2CO_3$
DILUTE ACID
WASTE ACID
AUT

ACID WASH OF SECOND CYCLE SOLVENT IN THE RECOVERY OF URANIUM FROM PHOSPHATE ROCK

BACKGROUND OF THE INVENTION

Uranium can be recovered from phosphoric acid by solvent extraction. In the first cycle of preferred processes using a di-2-ethylhexylphosphoric acid/trialkylphosphine oxide (D2EHPA/TOPO) solvent mixture, the uranium is reductively stripped from the solvent using phosphoric acid containing a high concentration of ferrous iron. The uranium can be recovered from this strip acid by first oxidizing the acid and then re-extracting the uranium, preferably with a D2EHPA/TOPO solvent mixture in a second cycle extraction. The uranium can be recovered from the second cycle solvent using an ammonium carbonate strip solution and a precipitation stage. This process is well known in the art, and is taught for example by Hurst et al., in U.S. Pat. No. 3,711,591; Elikan et al., in U.S. Pat. No. 3,966,873 and Sundar, in U.S. Pat. No. 4,002,716.

In this second cycle operation, the second cycle organic solvent, which is loaded with uranium after the extraction step, also contains entrained $H_3PO_4$ and other impurities which must be removed. Hurst et al., Elikan et al., and Sundar, cited above, attempted to solve this problem solely with a 100% water wash or scrub between the second cycle extractor and the second cycle stripper. However, as $H_3PO_4$ is removed by a 100% water wash, the phase disengagement in the scrubber becomes very poor. As a result, contaminated water containing $H_3PO_4$ can be carried with the organic solvent to the stripper. The $H_3PO_4$ may then be stripped by the ammonium carbonate and precipitated as a $P_2O_5$ compound, and this can affect the purity of the final, recovered uranium material, especially at high commercial through rates.

Wiewiorowski et al., in U.S. Pat. No. 4,105,741, attempted to remove carbonate after a second cycle stripping step. There, a separate step of washing the second cycle solvent was used, after uranium stripping with carbonate. This required an outside stream of a purified acid selected from sulfuric, hydrochloric, nitric or iron-free phosphoric acid. The acid treated stream was then fed back to the second cycle extractors. However, this would not solve $H_3PO_4$ entrainment problems which might occur prior to stripping.

SUMMARY OF THE INVENTION

The above problems are solved, and the above needs are met by contacting the $H_3PO_4$ laden, organic, second cycle solvent stream with a dilute aqueous solution of acid, selected from the group consisting of sulfuric or nitric acid in an acid scrubbing means. This acid scrubbing will only occur after the second cycle solvent exits the extractor means and before the second cycle solvent enters the stripper means. The washed, $H_3PO_4$ barren organic solvent can be fed to the second cycle stripper-precipitator, and then can be recirculated to extract uranium from oxidized acid in the second cycle extractor.

BRIEF DESCRIPTION OF THE DRAWINGS

For a better description of the invention, reference may be made to the preferred embodiments exemplary of the invention, shown in the accompanying drawing, which shows a flow diagram, illustrating one embodiment of the method of this invention for first and second cycle stripping of uranium from a wet process phosphoric acid feed.

DESCRIPTION OF THE PREFERRED EMBODIMENTS

Referring to the drawing, in Cycle I, purified phosphoric feed acid from line 1 enters extractor-settler means 2, which may contain 1 to 6 stages. This feed from domestic phosphate is typically a 35° C. to 50° C. aqueous 5 M to 6 M solution of wet process phosphoric acid having a pH of about 0.1 to about 2.5, and containing about 0.1 to about 0.5 g/l of uranium (as the oxidized uranyl ion, $UO_2^{+2}$), about 600 g/l of phosphate and about 3 to 15 g/l of iron. In the process shown, the phosphoric acid may be oxidized by any suitable means, to ensure that the uranium is in the +6 oxidation state, i.e., uranyl ion. In the extractor-settler 2, the feed acid is contacted by mixing with a water-immiscible, organic extractant composition from line 3. The organic extractant solvent composition contains reagents which extract the uranyl ions into the organic solvent.

Typically, the solvent composition from line 3 is added in a 0.5 to 1 solvent to phosphoric feed acid ratio (by volume). The solvent composition from line 3 contains about 0.2 to 0.7 mole of a di-alkyl phosphoric acid additive having about 4 to 10 carbon atoms in each chain, preferably di-2-ethylhexyl phosphoric acid (D2EHPA) per liter of solvent. The solvent also contains about 0.025 to about 0.25 mole of a synergistic additive agent well known in the art, for example, a trialkylphosphine oxide, where the alkyl chains are linear from $C_4$ to $C_{10}$, preferably tri-n-octylphosphine oxide (TOPO) per liter of solvent. These synergistic agents allow reduction of equipment size while increasing uranium extraction. The solvent is usually kerosine. The use of the term "solvent stream" herein is meant to include such additives as described above. While the description herein is primarily directed to D2EHPA/-TOPO mixtures, it is to be understood that other dialkyl phosphoric acid/trialkylphosphine oxides are included.

The organic solvent stream, contaning complexed oxidized uranium, passes through line 4 to reductive stripper means 5, which may contain 1 to 4 stages, to strip uranium from the organic solvent. A portion of the phosphoric acid raffinate from extractor 2 typically passes through line 7 to reducer 8 where iron (Fe°) is added to reduce enough ferric ions to bring the ferrous ion concentration up to a level sufficient to efficiently reduce and strip the uranyl ion in the reductive stripping operation. The ferrous ion enters reductive stripper 5 by line 9 and is oxidized there to the ferric ion, while reducing the uranyl ion to the quadravalent $U^{+4}$ ion, which is transferred to the aqueous phosphoric strip solution exiting in line 10. The organic solvent leaving the stripper is then recycled through line 3 to extractor 2. An appropriate portion of the first cycle raffinate acid exits by line 12.

Finally, the $U^{+4}$ ion in the phosphoric acid strip solution in line 10 is oxidized to the uranyl ion in oxidizer 11, to enable the uranium to be extracted again in Cycle II. The product stream 13 from Cycle I contains $H_3PO_4$ and typically has a pH of about 0.1 to 2.5. It contains about 25 g/l to 40 g/l of iron, and about 3 g/l to 15 g/l of uranium.

CYCLE II

The oxidized, aqueous, phosphoric acid liquor solution in line 13 contains uranium in the hexavalent state i.e., the uranyl ion. The aqueous liquor passes through line 13 to liquid-liquid solvent extractor 17. The aqueous phosphoric acid liquor is mixed with a water-immiscible, organic solvent stream from line 18, which extracts the uranyl ions into the organic solvent. In addition, some $H_3PO_4$ becomes entrained in the organic solvent.

The solvent stream 18 is generally the same as that of feed line 3, i.e., preferably about 0.2 to 0.7 mole of dialkyl phosphoric acid additive, well known in the art, having 4 to 10 carbon atoms in each chain, preferably di-2-ethylhexyl phosphoric acid (D2EHPA) per liter of solvent. The solvent stream also contains about 0.025 to about 0.25 mole of a synergistic additive agent well known in the art, for example, a trialkylphosphine oxide, where the alkyl chains are linear from $C_4$ to $C_{10}$, preferably tri-n-octylphosphine oxide (TOPO) per liter of solvent. Entrained $H_3PO_4$ present in the organic solvent stream of line 20 will be removed in acid scrubbing means 21, as described below, to provide the uncontaminated stream 24. Typically, the volume ratio of solvent stream 18:aqueous liquor of line 13 fed into the second cycle extractor is about 1:4 to 1.

The organic solvent stream, containing complexed uranium and entrained $H_3PO_4$, leaves extractor 17 through line 20. The organic solvent in line 20 is scrubbed with selected dilute acid in acid scrubber 21 to remove $H_3PO_4$ entrainment which would increase the ammonia consumption in the stripper-precipitator 25. The selected dilute acid scrub solution enters acid scrubber 21 by line 22 and waste acid leaves by line 23. Within acid scrubber 21, there is a recycle of dilute acid scrub solution, not shown in the drawing. The uncontaminated organic solvent then passes through line 24 to stripper 25.

The dilute acid scrub solution stream 22 must contain from 2 vol. % to about 10 vol. %, preferably between 2 vol. % and 6 vol. % of acid selected from the group consisting of nitric acid and preferably sulfuric acid, usually added to water in concentrated form to get the appropriate vol. % described above. Other acids, such as hydrochloric acid or additional phosphoric acid, compound the impurity problem. Under a concentration of 2 vol. % acid, the pH will increase and the organic solvent will entrain an excess of $H_3PO_4$ and consume excess amounts of ammonium carbonate on the stripper. Over 10 vol. % acid, the acid solution will become incompatible with the stainless teel or fiberglass used in plant construction and the acid waste will become a problem.

The acid scrub solution 22 is allowed to contact organic in the scrubber in an amount effective to maintain the pH in the acid scrubber and the solvent stream 24 at a value between about 3 and 6.5. Removal of $H_3PO_4$ in the scrubber 21 solely by water was found to drive the pH of the exiting organic stream 24 up to about 7.5 and provide precipitated $P_2O_5$ compounds in the final product. Over about a pH of 7.0, phase disengagement in the scrubber was found to be poor. The use of aqueous nitric or sulfuric acid solves these problems and accomplishes three results. It is effective in removing $H_3PO_4$ from stream 20 and stripper 21, it maintains the pH of the acid stripper and the exiting stream 24 at between about 3 and 6.5; and thus allows effective stripping in stripper-precipitator 25.

By the process of this invention little or no $H_3PO_4$ is transferred to ammonium carbonate in the stripper-precipitator, so that there is no precipitated $P_2O_5$ contamination of the final uranium compound. The effective steady state volume ratio of organic containing entrained $H_3PO_4$ in line 20:total aqueous acid scrub solution in scrubber 21 is from about 80:20 to 60:40, preferably 70 volumes:30 volumes. Over 40 volume parts acid per 60 volume parts organic, will provide an aqueous continuous phase ratio causing increased entrainment of scrub acid containing $H_3PO_4$. Under 20 volume parts acid per 80 volume parts organic, the contact efficiency will drop so that impurity removal will become poor. This aqueous acid scrub between the extractor and stripper is effective to remove from 95 vol. % to 98 vol. % of entrained phosphoric acid without raising the pH of the organic exiting the scrubber 21. The term "steady state volume ratio" is meant to include total acid scrub solution in the scrubbers 21, which includes not only the volume from line 22 but also the volume amount recycled within scrubber 21.

In the stripper 25, the organic solvent stream is stripped with an aqueous solution containing enough ammonium compounds, such as ammonium carbonate, ammonium bicarbonate, or a mixture thereof from line 26 to precipitate a uranium complex from the organic phase. The preferred uranium complex is AUT (ammonium uranyl tricarbonate) as it is easy to filter. The organic solvent stream is recycled through line 18. The aqueous slurry containing the precipitated AUT passes through line 27 to AUT filter 28 where AUT is filtered off.

The filtrate is recycled through line 29 to stripper-precipitator 25. A 0.5 M ammonium carbonate solution is added to line 29 as needed from line 30 to make up for water losses. The precipitated AUT can be calcined in an oven at about 350° C. to about 900° C. which drives off carbon dioxide and ammonia. If the calcining is done in a reducing atmosphere, such as a hydrogen-nitrogen mixture, $UO_2$ is obtained and collected. If the calcining is done in an oxidizing atmosphere, such as air, the mixed oxide $U_3O_8$ is obtained and collected.

The acid scrubber can be a single or multiple stage apparatus. In a multiple stage apparatus, there may be two or more wash units with dilute acid contacting organic solvent in one or more of the wash units, and a dilute acid scrub solution recycle.

EXAMPLE 1

The second cycle of a uranium recovery process was modified, as shown in the drawing, so that second cycle extractant, comprising $H_3PO_4$ laden di-2-ethylhexyl-phosphoric acid and tri-n-oxtylphosphine oxide in kerosene solvent, from the second cycle extractor was piped into an acid scrubber system. About 0.50 mole of D2EHPA and 0.125 mole of TOPO was present per liter of kerosene. The organic contained an amount of $H_3PO_4$ calculated to be equivalent to about 0.3 grams per liter of $P_2O_5$. In the acid scrubber, the organic solvent extractant was mixed with a 3 vol. % aqueous scrub solution of sulfuric acid in t. The washed, $H_3PO_4$-free extractant was then fed into the second cycle stripper means, where the uranium was then stripped to precipitate ammonium-uranyl-tricarbonate. Throughout, the pH of the organic stream between the acid scrubber and the stripper remained at about 4.

Prior to installation of the separate aqueous acid scrubbing unit of this invention, because of $H_3PO_4$ $P_2O_5$ contamination, additional 100% water was added in the scrubber, causing the pH of the stream fed into the stripper to gradually rise to a value of about 7.5. This caused poor phase disengagement in the stripper with resulting contaminated water being carried with the solvent. Eventually $H_3PO_4$ became entrained in the ammonium carbonate exiting the stripper. The exiting, contaminated ammonium carbonate contained an amount of $H_3PO_4$ calculated to be equivalent to over 3,000 ppm. of $P_2O_5$. With the addition of the dilute sulfuric acid according to this invention, the phase separation in the scrubber became very fast, water entrainment in the solvent became very small and the resultant precipitation purity was greatly improved. After 2 weeks of operation a steady state was reached, and the calculated $PO_5$ concentration in the ammonium carbonate dropped to 725 ppm. After further continuous operation the calculated $P_2O_5$ concentration dropped to between 100 ppm. to 300 ppm., where it was consistently maintained.

I claim:

1. In the process of recovering uranium from an aqueous solution of wet process phosphoric acid feed, comprising a first and a second cycle, where phosphoric acid is passed through extractor means and stripper means in both cycles, where the first cycle utilizes reductive stripping and both the first and second cycle utilize an organic extractant solvent containing a di-alkyl phosphoric acid having from about 4 to 10 carbon atoms in each alkyl chain and a synergistic additive agent; the improvement comprising treating the second cycle organic solvent stream, from the second cycle extractor means, containing entrained $H_3PO_4$, to remove $H_3PO_4$ therefrom, before said solvent has passed through the second cycle stripper means, said treating consisting of acid scrubbing said second cycle organic solvent stream containing entrained $H_3PO_4$ with an aqueous acidic solution consisting of water and from about 2 vol. % to about 10 vol. % of acid selected from the group consisting of sulfuric acid and nitric acid, said acidic solution added in an amount effective to remove entrained $H_3PO_4$ and maintain the pH of the organic solvent stream exiting the acid scrubber at a value of between 3 and 6.5, to provide a substantially $H_3PO_4$ free organic solvent stream which is then fed directly into the second cycle stripper means.

2. The method of claim 1, wherein the acid scrubbing is effective to remove from 95 vol. % to 98 vol. % of the $H_3PO_4$, the acid is sulfuric acid, and the steady state volume ratio of the second cycle organic solvent stream containing entrained $H_3PO_4$:total aqueous acid is from about 80:20 to 60:40.

3. The method of claim 1, wherein the second cycle organic solvent stream contains a di-alkyl phosphoric acid and a trialkylphosphine oxide synergistic agent, where the alkyl chains are linear from $C_4$ to $C_{10}$.

4. The method of claim 1, wherein the second cycle organic solvent stream consists of di-2-ethylhexyl phosphoric acid and tri-n-octylphosphine oxide in kerosine solvent.

5. The method of claim 1, including the additional step of cycling the acid scrubbed, $H_3PO_4$ free organic solvent stream back into the second cycle extractor means, to contact a stream of oxidized phosphoric acid.

6. The method of claim 1, wherein the acid is concentrated acid, and the substantially $H_3PO_4$ free organic solvent stream contacts aqueous ammonium carbonate solution in the second cycle stripper means where uranium values are stripped from the organic solvent stream.

* * * * *